US006461285B1

(12) United States Patent
Theunissen et al.

(10) Patent No.: US 6,461,285 B1
(45) Date of Patent: Oct. 8, 2002

(54) BALANCE TRAINER

(75) Inventors: Josef Theunissen, Luedenscheid; Ludolf Jakobs, Kerpen, both of (DE)

(73) Assignee: Jakobs GmbH, Kerpen (DE)

( * ) Notice: Subject to any disclaimer, the term of this patent is extended or adjusted under 35 U.S.C. 154(b) by 1 day.

(21) Appl. No.: 09/619,695

(22) Filed: Jul. 19, 2000

(51) Int. Cl.[7] ..... A63B 22/14
(52) U.S. Cl. ..... 482/146; 273/110
(58) Field of Search ..... 482/146–147, 482/142, 145, 71; 273/110, 115; 446/168

(56) References Cited

U.S. PATENT DOCUMENTS

| | | | | | |
|---|---|---|---|---|---|
| 3,188,087 | A | * | 6/1965 | Larson, Jr. | 273/110 |
| 3,806,116 | A | * | 4/1974 | Malmberg et al. | 272/57 |
| 3,811,676 | A | * | 5/1974 | Greenberg | 273/110 |
| 3,829,088 | A | * | 8/1974 | Pahlas | 273/1 M |
| D255,372 | S | * | 6/1980 | Tidmore | D21/193 |
| 4,532,194 | A | * | 7/1985 | Liautaud et al. | 429/99 |
| 4,613,131 | A | * | 9/1986 | Anderson | 272/146 |
| 4,787,630 | A | * | 11/1988 | Watson et al. | 272/146 |
| 5,042,808 | A | * | 8/1991 | Shoptaugh | 273/110 |
| 5,330,399 | A | * | 7/1994 | Fan | 482/34 |
| 6,019,712 | A | * | 2/2000 | Duncan | 482/110 |

FOREIGN PATENT DOCUMENTS

| | | | | |
|---|---|---|---|---|
| FR | 2592802 | * | 7/1987 | 482/146 |

* cited by examiner

*Primary Examiner*—Justine R. Yu
(74) *Attorney, Agent, or Firm*—Paul Vincent

(57) ABSTRACT

A balance training apparatus has replaceable and exchangeable inserts tailored to accommodate various uses and to demand balancing skills of the user in dependence on personal attributes of the user. A moving object is disposed within each of the inserts for directed motion by the balancing user. A window, preferentially made from a clear plastic material, provides for visual observation by the user of the moving object traveling through a respective insert path, such that the user can direct the moving object, preferentially a ball, towards a target or along a path. The window is attached to the house in a manner not requiring the use of tools, such that the user can easily remove the window for direct access to and exchange of the insert. Balancing training can be exercised over a plurality of azimuthal and radial balancing orientation directions in a manner appropriate for use by a wide variety of users including children, elderly people, and athletic individuals through simple exchange of appropriately tailored and structured inserts.

18 Claims, 7 Drawing Sheets

BALANCE TRAINER

This application is a further development of German utility model No. 29907509 filed on Apr. 28, 1999, the complete disclosure of which is hereby incorporated by reference.

BACKGROUND OF THE INVENTION

The invention concerns a balance training apparatus having a curved lower surface and an upper support surface upon which a user stands in a balanced state.

Balance apparatus are used for various therapeutic and athletic applications. In particular, the interactions involved in the balancing process between various sense organs and sensory inputs as well as motoric and psychological as well as neurological interdependencies enjoy a special position in the training of coordination, balancing, and reflexes. A conventional apparatus as e.g. disclosed in brochure "The Wobbler" published by Wagus GmbH, Rheinstetten, Germany, in 1992 discloses a balancing apparatus having a structured partially polygonal lower surface. The apparatus supports a user standing thereon. The standing surface for the user is displaced in a backward position relative to a forward portion of the apparatus in which a ball is accommodated for spiraled movement. The user attempts to position the ball through the spiraling structure from an outside position to an inside position or vice versa while balancing on the apparatus. The lower support surface for the apparatus is structured to aid the user in his balancing procedure in a directional sense so that certain directions of motion are supported to a greater or a lesser degree than others. The apparatus has a plate for an auxiliary exercise which can be placed over the spiraling portion of the apparatus. The plate has 3 recesses within which a ball can be captured during balancing.

The brochure "Therapiekreisel" published by Motio GmbH, Karlsruhe, September 1996 discloses a balancing apparatus having a substantially planar upper surface and a curved lower surface. The user stands on the planar upper surface, preferentially with one foot, and attempts to maintain balance during use.

The above mentioned balancing apparatus share the common disadvantage of being either too simple or too difficult for various users. An apparatus suitable for use by children is often inadequate to train an athletic individual. Conversely, apparatus which are appropriate for balancing activities of healthy, athletic individuals are much too difficult for elderly people or for children to use.

It is therefore the underlying purpose of the present invention to develop a balancing apparatus which is appropriate for use by a wide variety of people and for a wide variety of differing applications.

SUMMARY OF THE INVENTION

The purpose of the invention is accomplished with a balance training apparatus comprising a housing having a smoothly curved, convex lower surface and a substantially flat upper surface, the substantially flat upper surface having first and a second support surfaces radially displaced outward from said curved symmetric lower surface. The upper surface defines a central recess disposed between the first and the second support surfaces directly above the lower surface. An insert seats in an exchangeable fashion, without the use of tools, in the recess defined in the housing, the insert comprising raised and lower structures defining obstructions and paths. A moving member, such as a ball, seats within the insert for motion and is disposed for travel through the paths. A window seats on the upper surface of the housing and rests on the raised portions of the insert to capture the moving member within the insert surface. Latching means are provided, cooperating with the window and the housing, to permit removal of the window, without the use of tools, for exchange of the insert, wherein the raised structures of the insert are disposed to support vertical loads throughout the entire surface of the window.

The smooth, curved convex lower surface of the balance training apparatus in accordance with the invention results in substantially symmetric balancing demands in all directions. The two upper support surfaces are adapted to allow the feet of the user to be placed symmetrically or asymmetrically with respect to the central insert. The latching means cooperates with the window in the housing to allow easy removal and exchange of the insert, wherein differing inserts can be used for differing applications. The structures, raised and lowered in certain portions of the insert, are disposed to challenge balancing during movement and navigation of the moving member according to the application dictated by the respective insert, while nevertheless providing sufficient support for the window to also allow the user to stand on any portion of the window without causing damage to the insert, the housing, or the window. In this fashion, the entire surface of the balancing training apparatus in accordance with the invention is available for use by the user, either standing on one foot or two feet, at various locations throughout the upper surface of the apparatus. Inserts which are inappropriate for one user can be easily exchanged for inserts which are desirable for use by another user so that the apparatus can be tailored to the individual needs of the user.

In an advantageous embodiment of the invention, the raised and lowered structures of the insert define a path having a figure 8 shape. This embodiment has the advantage that the figure 8 is a particularly useful training tool for initial adjustment of balance in the forward, backward, and sideward directions without providing excessive difficulty to the user. The recess and/or, the window and/or the figure 8 structure can have latching means defining certain angular positions of the figure 8 relative to the housing. For example, the elongated axis of the 8 can be parallel or perpendicular to a vertical plane passing through feet of the user. In this manner, different balancing directions and skills can be exercised in dependence on the orientation of the figure 8 relative to the user's feet.

In an additional preferred embodiment of the invention, the raised and lowered structures of the insert define a path having a labyrinth shape. This embodiment has the advantage of providing a balancing test for the user in which both radial as well as azimuthal balancing skills are required. The labyrinth structure dictates a path through which a ball or other moving object must travel while the user maintains his balance on the apparatus. In this fashion, a high degree of motoric and coordination skills are exercised in a plurality of balancing directions.

In a further improved embodiment of the invention, the raised and lower structures of the insert define a plurality of obstacles and at least one receptacle. This embodiment has the advantage of challenging the user to direct the moving object through the plurality of obstacles to seat in a receptacle. Since the path of approach of the moving object to the receptacle can assume a wide variety of angular directions, balancing skills are challenged in a dynamic fashion in dependence in the instantaneous direction of approach of the ball towards the receptacle.

In an improvement of this embodiment, the raised and lowered structures define 3 obstacles and the receptacle has a shape matched to capture the moving member when said moving member travels towards said receptacle along certain paths. This improvement has the advantage of providing a game-like task to the user which is particularly appropriate for children. The user attempts to direct the moving member towards the receptacle to capture the moving member in the receptacle while avoiding the obstacles. The game-like effect of the balancing process increases enjoyment of the user during training.

In a further improvement of this embodiment, the moving member has a mouse-like appearance. This embodiment has the advantage of providing game-like training, particularly appropriate for children. In this application, the receptacle serves a function of a mouse-trap for the game-like balancing exercise in which the mouse becomes captured. The user, preferentially a child, therefore undergoes a training experience which is playful in nature.

In a further development of this embodiment, the three obstacles comprise a triangular shape, a rectangular shape, and a circular shape. This improvement has the advantage that the different surfaces upon which the moving member engages the various shaped obstacles have various reflection effects on the subsequent direction of the moving member such that deflected orientation of the moving member changes in dependence on which of the three obstacles are encountered.

In a preferred embodiment of the invention, the raised and lowered structures define a plurality of receptacles. This embodiment has the advantage of providing a plurality of receptacles in various locations along the insert to thereby vary the path of approach of the moving object and the associated balancing training procedure in dependence on the target receptacle.

In an improvement of this embodiment, the plurality of receptacles have pockets of differing shapes and depths for capture of the moving member. This embodiment has the advantage of comprising different degrees of difficulty for the various receptacles. In a game-like application of this embodiment, differing numbers of points can be assigned to successful capture of a moving member in the various pockets to thereby increase the challenge and pleasure of the training experience.

In an improvement of this particular embodiment, a plurality of moving members is provided which is equal to the plurality of receptacles. This particular embodiment has the advantage of providing a highly challenging game-like balancing experience to the user by requiring the user to simultaneously capture a plurality of moving members in corresponding receptacles.

In a further development of this embodiment, the raised and lowered structures also define obstacles. This embodiment has the advantage of increasing the challenging balancing experience of the user by preventing capture of the moving objects in the receptacles from arbitrary incident angles.

In an improvement of this embodiment, the obstacles are disposed radially inward from the plurality of receptacles. This embodiment has the advantage of preventing direct diametrical access of the moving objects across the center of the insert by requiring the user to thread the moving body through the obstacle or by causing the user to circumvent the obstacle by changing the direction of travel of the moving object.

In a preferred embodiment of this particular application, there are three moving members and three receptacles. This embodiment has the advantage of providing for three different levels of difficulty during the course of the balancing experience through the requirement of the simultaneous capture of one, two and three moving objects. In a preferred improvement of this particular embodiment, one of the three receptacles is U-shaped, one is Y-shaped, one is V-shaped. This embodiment has the advantage of changing the degree of difficulty with which the moving object is captured in the corresponding receptacle, since the shape of the receptacle in both the receiving portion as well as opposite to the receiving portion has different deflection action on the approaching moving object. For example a Y-shaped receptacle will deflect a moving object approaching from the back of the Y to a larger degree then a V-shaped receptacle. A U-shaped receptacle can be fashioned to provide a minimum amount of deflection to the moving object when the receptacle is approached from the rear. The receptacles can also have differing opening sizes and depths.

In a preferred embodiment of the invention, strap means are provided mounted to the housing to provide balance support for the user. This embodiment has the advantage of providing a reduced skill level for the user to aid an inexperienced user or user of limited athletic or motoric capability to exercise with the apparatus in accordance with the invention.

In an improvement of this embodiment, the strap means comprise a bracket for latching connection to said housing, a belt attached to said bracket, a buckle mechanism for adjusting the length of the said belt and a handle attached to said belt for grasping by the user. This embodiment has the advantage of providing a support for users of various sizes which is adjustable to the user height. The latching connection of a bracket to the housing allows the strap means to be attached to the housing and detached therefrom without the use of tools. The handles facilitate use of the strap means. Two strap means are normally provided for use by the user in the right and left hands thereof.

In a preferred improvement, the housing comprises plastic molded walls. This embodiment has the advantage of providing a low weight, low cost and strong structure for the housing.

In a further improvement of the invention, the housing walls define grasping recesses disposed below each of said first and second support surfaces. This embodiment has the advantage of facilitating easy carrying and transport of one or of a plurality of balance training apparatus.

Further advantages and features of the invention can be extracted from the preferred embodiment as illustrated in the drawings. The embodiments are intended to have exemplary character only and are by no means an exhaustive enumeration of all inventive configurations.

BRIEF DESCRIPTION OF THE PREFERRED EMBODIMENT

Figure 1:
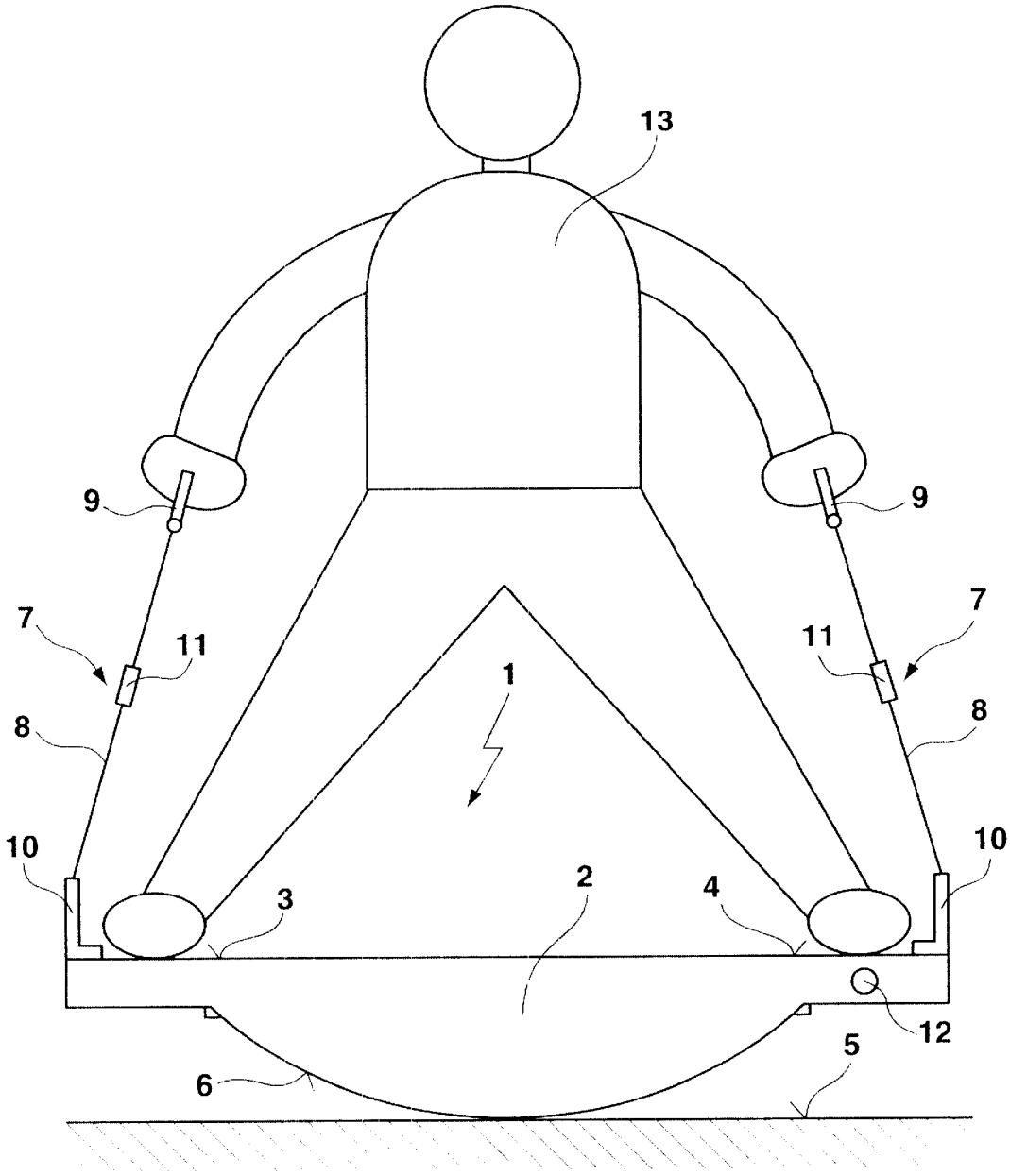
FIG. 1 shows an overall view of a user and the balance training apparatus in accordance with the invention.

FIG. 1 illustrates the balance training apparatus 1 in accordance with the invention. The balance training apparatus 1 comprises a housing 2 having support surfaces 3, 4 adapted for accepting the feet of the user 13. A curved lower surface 6 of the housing 2 is placed upon a underlying surface 5. The underlying surface 5 can be elastically resilient (e.g. a foam pad). The smooth curved surface 6 therefore provides a small contact surface between the underlying surface 5 and the housing 2 to thereby require the user to exercise balancing skills. Straps 7 can be attached to the housing to aid the user in balancing activities, the straps 7 comprising belt members 8 attached to the housing via brackets 10 at sides proximate the seating surfaces 3, 4. A buckle 11 can be provided for adjusting the length of the belt 8. Handles 9 aid the user 13 in grasping the straps 7. The brackets 10 can be structured for latched attachment to the housing 2 without the use of tools. In the event that the housing 2 is made from an extruded and/or molded hollow structure, a stopper 12 can be provided to prevent air from escaping out of the housing.

Although the user 13 is shown in a standing position in FIG. 1, the apparatus in accordance with the invention can also be used by users 13 kneeling on the apparatus or even holding the apparatus in their hands. With this latter possibility, the strap means can be placed appropriately around the neck of the user 13 in order to provide additional support for the balance training apparatus 1.

Figure 2:
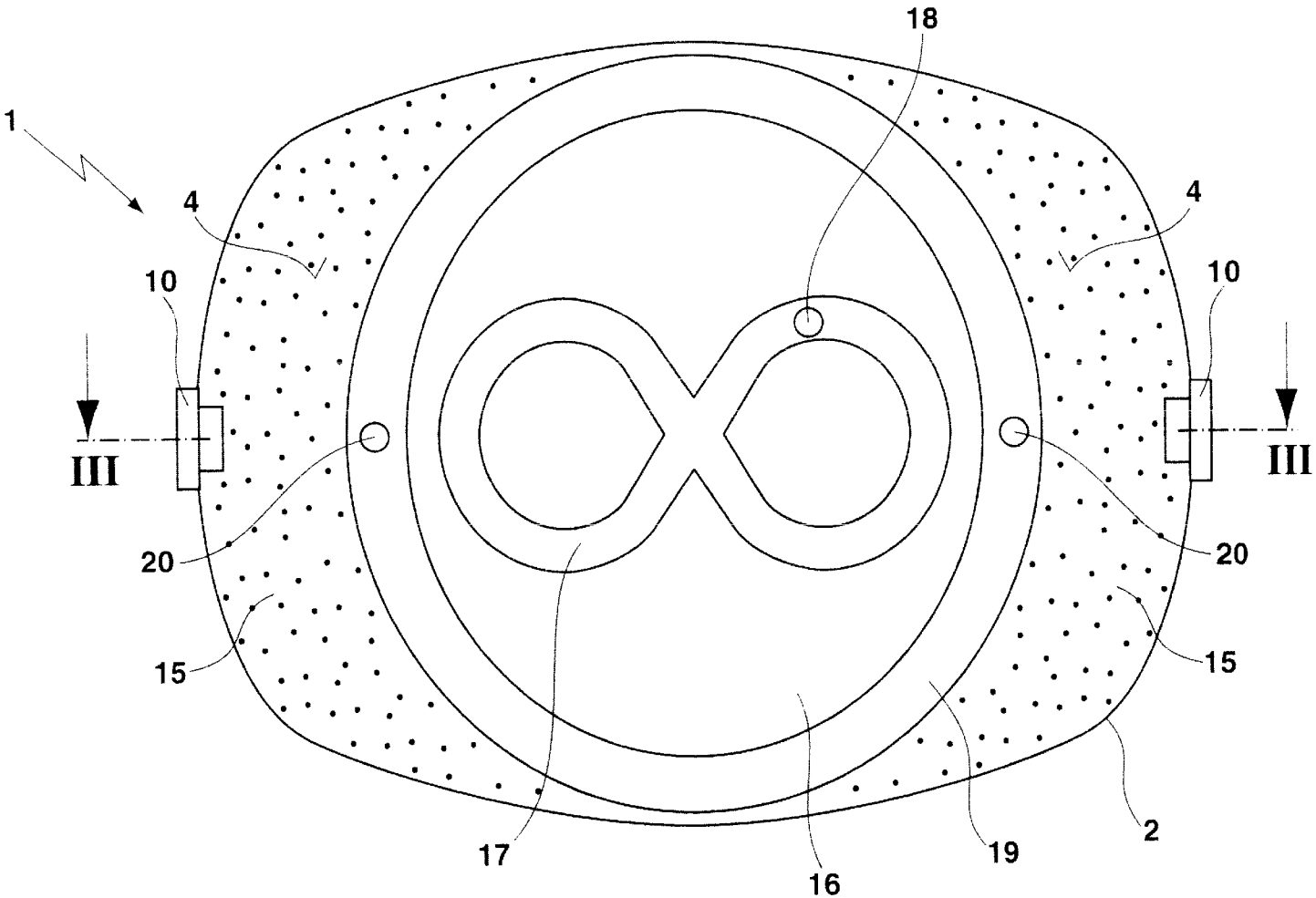
FIG. 2 shows a plan view of a figure 8 insert for use of the apparatus in accordance with the invention.
Figure 8:
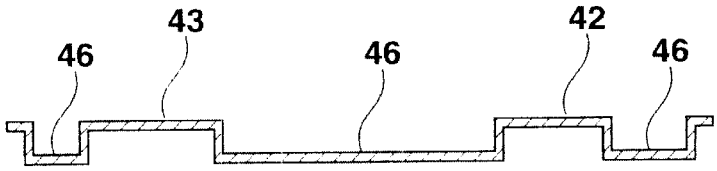
FIG. 8 is a section through the insert in accordance with FIG. 7.

FIG. 2 shows a plan view of the balance training apparatus 1 having a figure 8 insert 16. The support surfaces 4 are configured with a structured area 15 comprising e.g. raised nubs or other roughened structures. The structures 15 prevent or curtail slippage of the user from the support surfaces 4. The figure 8 insert defines tracks 17 within which a ball 18 travels. In the orientation shown, the axis of the figure 8 passes through a transverse axis of the user 13. Other embodiments are possible in which the figure 8 insert 16 is rotated with respect to the illustration of FIG. 2, through e.g. 90°, and means can be provided for fixing the orientation of the figure 8 relative to the housing 2. A transparent window 19 is provided for capturing the figure 8 insert 16 and to prevent the ball 18 from leaving the insert 16 structure. The window 19 is generally constructed from a clear plastic material to enable the user 13 to view the insert 16 and movement of the ball 18 during use. Latching means 20 are provided for mounting the window 19 to the housing 2. The latching means 20 can pass through appropriate holes fashioned in the window 19 and in the housing 2, as will be described in greater detail with reference to the following figures.

Figure 3:
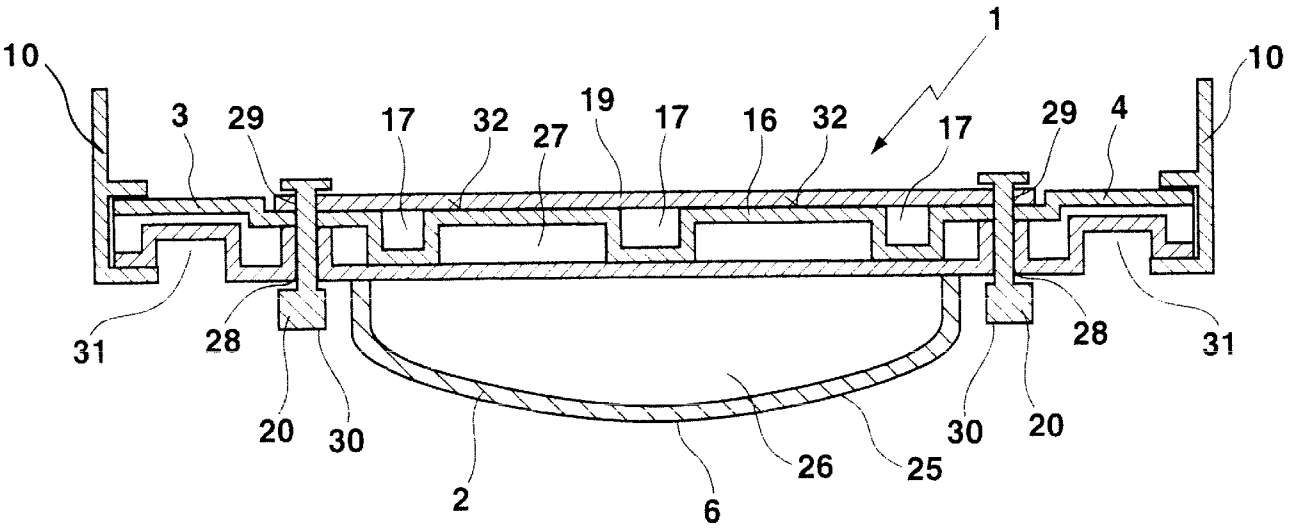
FIG. 3 shows a section through the apparatus of FIG. 2.

FIG. 3 shows a cross-section III—III through FIG. 2. In this embodiment, the balance training apparatus 1 comprises a housing which defines a hollow structure. The curved lower surface 6 of the housing 2 defines a cavity 26 as appropriately fashion by molding to render the structure lightweight and strong. The latching means 20 can be fashioned as pins passing through appropriate holes 29 and 28 in the window 19 as well as in the housing 2. The latching means 20 can be configured with a latching foot 30 and the holes in the housing 28 and in the window 29 can be slotted in such a fashion that the latching member 20 only passes through the holes in a certain angular orientation. In this fashion, the latch 20 can be rotated to lock the window 19 with respect to the housing 2. In the embodiment of FIG. 3, the brackets 10 clip, in a U-shaped fashion, onto the outer portions of the housing 2 proximate the upper support surfaces 3, 4.

The insert 16 defines tracks 17 and has upper surfaces 32 which support window 19. In this fashion, the user 13 can stand or kneel on any portion of the window 19 without compromising the structure of the apparatus.

The balancing apparatus 1 is preferentially molded plastic, defining plastic walls 25 containing cavity portions 26. The inserts, such as figure 8 insert 16, are also preferentially molded from plastic to define cavities 27 as well as tracks 17. The housing 2 can be molded to define grasping recesses 31 proximate an opposite side of the seating surface 3, 4 to facilitate transport and carrying of the balance training apparatus 1 or a plurality thereof.

Figure 4:
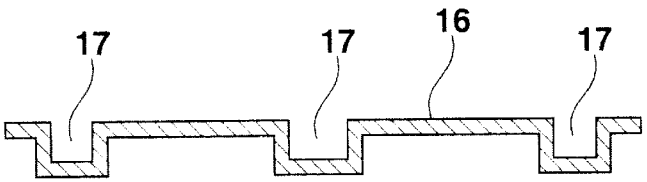
FIG. 4 shows a section through the insert of the apparatus in accordance with FIGS. 2 and 3.

A detail of the cross-section through the figure 8 insert 16 of FIGS. 2 and 3 in accordance with cut III—III of FIG. 2 is shown in FIG. 4.

Figure 5:
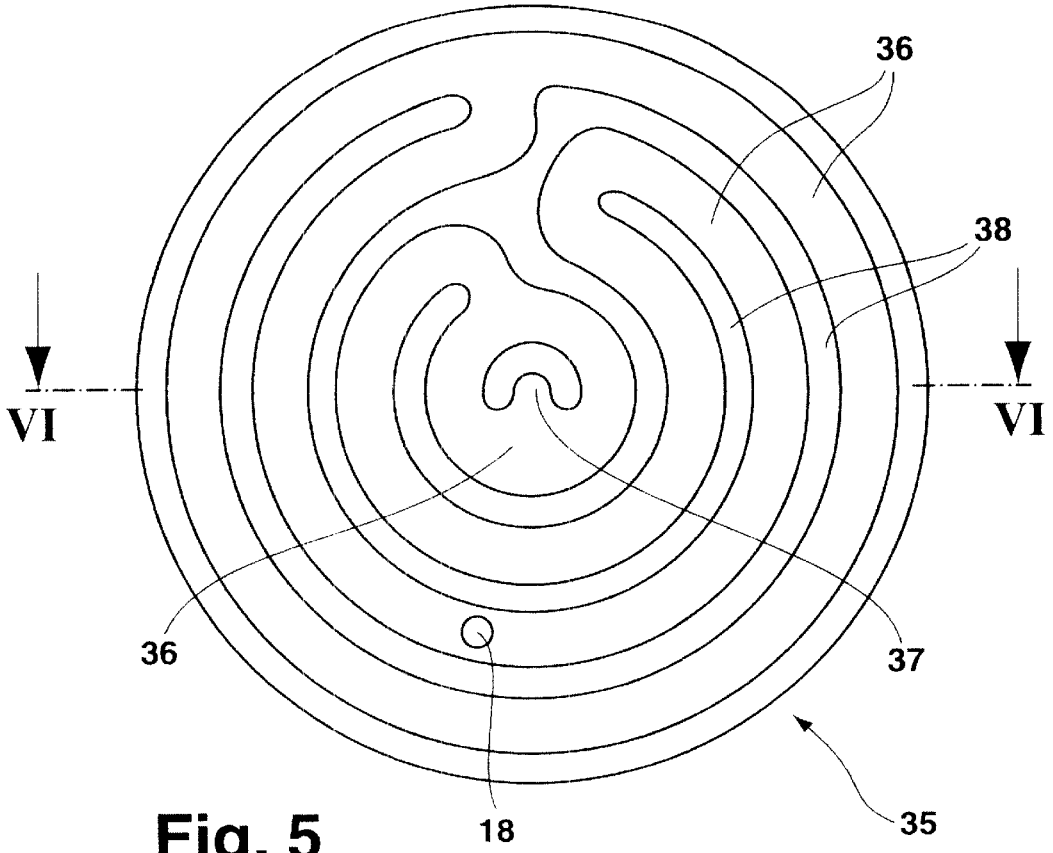
FIG. 5 is a plan view of a labyrinth insert in accordance with the invention.
Figure 6:
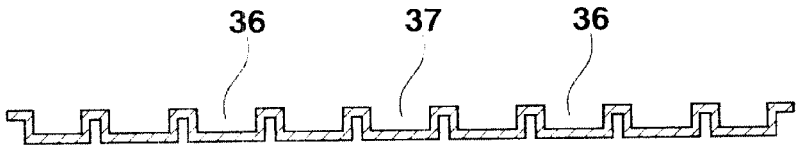
FIG. 6 is a cross-section through the insert of FIG. 5.

FIG. 5 shows a plan view of an additional insert in accordance with the invention. A cross-section in accordance with VI—VI through FIG. 5 is given in FIG. 6. The labyrinth insert 35 comprises a structure having raised and lower surfaces to define tracks 36, separated by walls 38. A ball 18 can be caused, through balancing activity on the part of the user, to travel radially and peripherally from one track region 36 of the labyrinth to another track region 36 thereof. A central receptacle 37 can be fashioned out of the central wall for capture of the ball 18 by a successful user.

All embodiments of inserts shown in the figures are appropriate for exchangeable placement within the recess portion of the housing 2, as best illustrated in FIG. 3.

Figure 7:
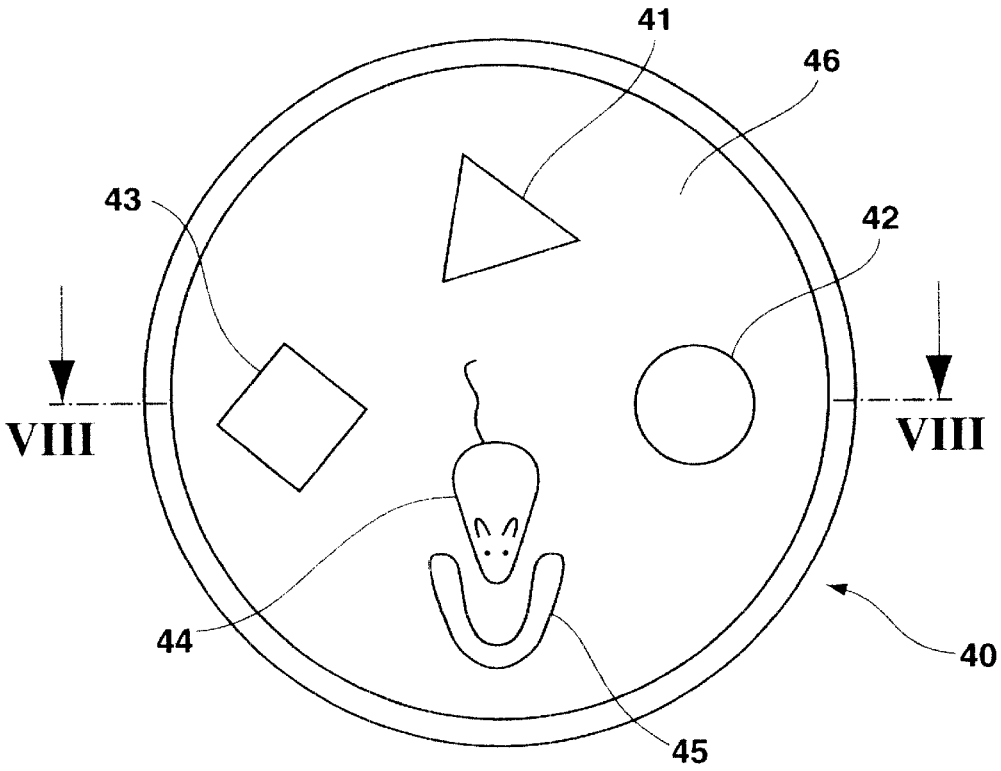
FIG. 7 is a plan view of another mouse-game insert in accordance with the invention.

FIG. 7 illustrates another embodiment of an insert in accordance with the invention and figure 8 shows a cross-section through the embodiment of FIG. 7 in accordance with VIII—VIII. The insert embodiment of FIG. 7 illustrates a mouse-game in which a mouse-like moving object 44 can be captured within a mouse-trap in the form of a U-shaped receptacle 45. The mouse-trap insert 40 is equipped with 3 obstacle structures 43, 41, 42 raised above a traveling surface 46 for the mouse 44. The user must attempt to move the mouse 44 along the supporting surface 46 to pass the obstacles 43, 41 and 42 to seat within the mouse-trap 45. The obstacle 43 has a rectangular shape, the obstacle 41 has a triangular shape and the obstacle 42 a round shape. In this manner, interactions between the mouse 44 and the obstacles 41, 42, 43 result in differing deflection directions for subsequent travel of the mouse 44, thereby providing varying challenges with regard to the balancing action of the user.

Figure 9:
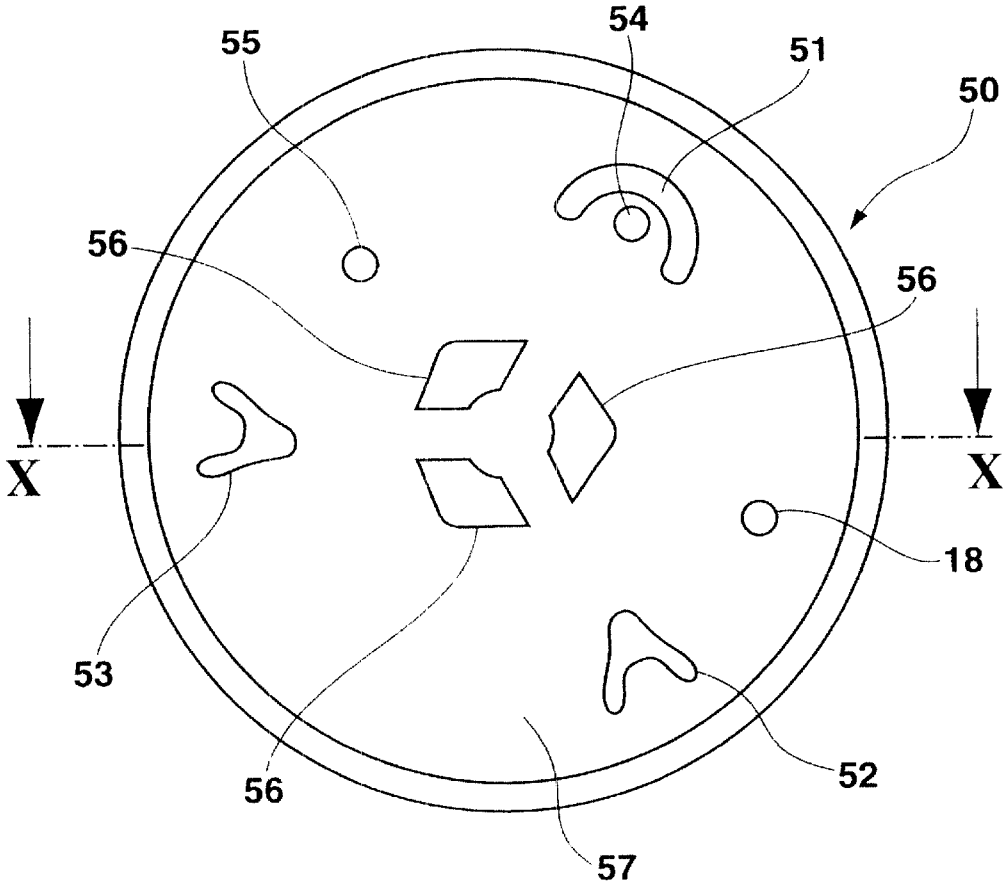
FIG. 9 is a plan view of another insert involving a plurality of basket-like capturing receptacles and a plurality of balls.
Figure 10:
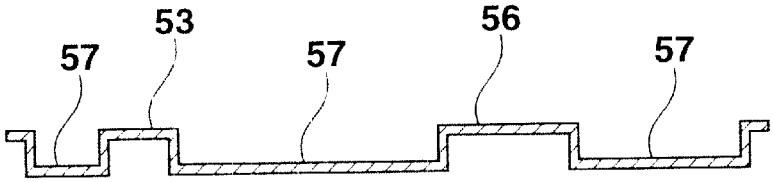
FIG. 10 is a cross-section through the insert in accordance with FIG. 9.
Figure 11C:
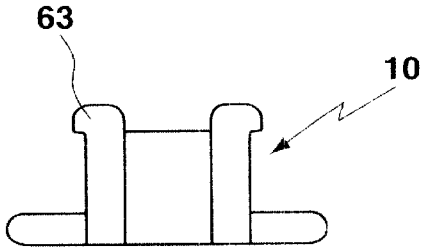
FIG. 11*c* is a bottom view of the bracket in accordance with FIGS. 11*a* and 11*b.
Figure 11A:
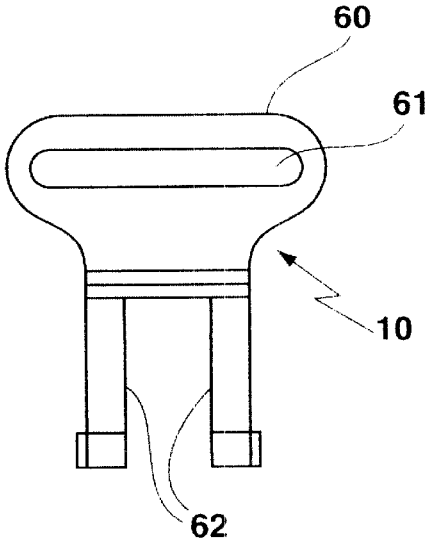
FIG. 11*a* is a first view of a bracket for attaching a user support strap means to the housing in accordance with the invention.
Figure 11B:
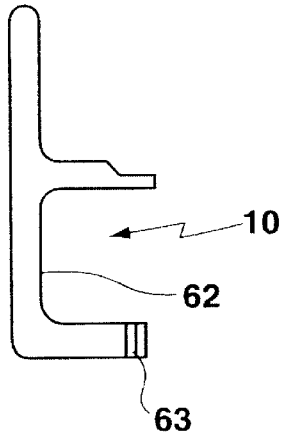
FIG. 11*b* is a side view of the bracket of FIG. 11*a;*
Figure 11D:
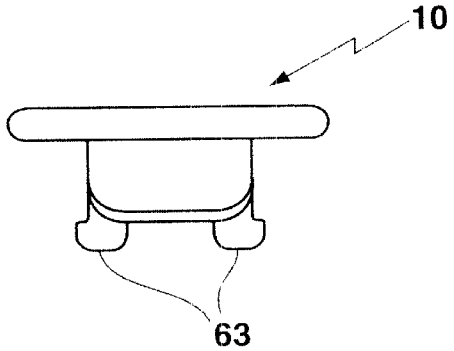
* and FIG. 11*d* is a top view of the bracket in accordance with FIGS. 11*a,* 11*b* and 11*c.*

FIG. 9 shows an additional insert in accordance with the invention for placement within the housing 2 as best illustrated in FIG. 3. FIG. 10 shows a cross-section X-X through FIG. 9. In the basket game insert 50 in accordance with FIGS. 9 and 10, a plurality of receptacles 51, 52, 53 are defined as raised positions of the insert having a U-shape 51, a Y-shape 53 and a V-shape 52. The receptacles 51, 52 and 53 can be configured with capture recesses of various depths and shapes to challenge capture of balls 18, 55 and 54 on the part of the user. A plurality of obstructions 56 are arranged at the center region of the insert 50. The obstructions 56 can be displaced with respect to each other in such a fashion that one or more of the balls 54, 55 and 18 can pass through separations between the obstructions 56. In the embodiment of FIG. 9, the obstructions 56 are fashioned as central impediments. Points can be awarded for successful, simultaneous capture of the balls in one, two and/or three of the receptacles 51, 52, 53 in dependence on the degree of difficulty associated with single and multiple capture thereof.

FIGS. 11*a*–11*d* show various views of an embodiment of the bracket 10 in accordance with the invention. In the embodiments of FIGS. 11*a*–11*d*, the bracket is configured as U-shaped latching member having a vertical rise passing into a head 60 having a slotted region 61. The upper portion of the bracket 10 has a width sufficient to accept a strap 8 for use by the user 13, as best illustrated in FIG. 1. The strap 8 can have a width of approximately 5 cm. The bracket 10 has leg-members 62 extending downwardly and in a forward direction to capture about the sides of the housing 2 (see FIG. 3). Latching noses 63 can be provided at extremities of the lower portions of the leg-members to engage into corresponding recesses of the housing 2 for attachment of the bracket 10 to the housing 2, without the use of tools.

LIST OF REFERENCE SYMBOLS

1 balance training apparatus
2 housing
3 support surface
4 support surface
5 underlying surface
6 curved surface
7 straps
8 belt
9 handle
10 bracket
11 buckle
12 stopper
13 user
15 structure
16 figure 8 insert
17 figure 8 track
18 ball
19 window
20 latch
25 molded wall
26 cavity
27 recess
28 housing bore
29 hole
30 latch foot
31 grasping recesses
35 labyrinth insert
36 labyrinth track
37 central receptacle
40 mouse insert
41 triangular impediment
42 circular impediment
43 rectangular impediment
44 mouse
45 mouse-receptacle
50 basket insert
51 U-receptacle
53 Y- receptacle
52 V-receptacle
56 central impediment
57 travel surface
60 bracket head
61 head slot
62 bracket leg-member
63 bracket latch nose

We claim:

1. An apparatus for balance training of a user, the apparatus comprising:

a housing having a smoothly curved, convex lower surface and a substantially flat upper housing surface, said upper housing surface having a first sidewardly disposed support surface and a second sidewardly disposed support surface, said second support surface opposite said first support surface, said first and said second support surfaces radially displaced outward from said curved lower surface, said upper housing surface defining a central recess disposed between said first and said second support surface and directly above said curved lower surface;

an insert, said insert seating for exchange, without the use of tools, in said central recess, said insert comprising raised and lowered structures defining obstructions and paths;

a moving member seating within said insert, said moving member disposed for travel through said insert;

a flat window of constant, uniform thickness, said window disposed within said central recess to seat and rest on said raised structures for capturing said moving member within said insert, said window and said raised structures being disposed and structured to accept a full weight of the user acting on said window during use of the apparatus, said central recess shaped to capture said window against slippage thereof in a horizontal direction and to cause said window to seat coplanar with said upper housing surface to define a smooth, stepless user support surface; and latching means cooperating with said window and said housing to permit removal, without the use of tools, of said window for access to and exchange of said insert.

2. The apparatus of claim 1, wherein said raised and lowered structures defines said paths to have a figure 8 shape.

3. The apparatus of claim 1, wherein said raised and lowered structures define said paths to have a labyrinth shape.

4. The apparatus of claim 1, wherein said raised and lowered structures define a plurality of obstacles and receptacles.

5. The apparatus of claim 1, wherein said raised and lowered structures define a plurality of obstacles and wherein said receptacle has a shape matched to capture said moving member when said moving member travels towards said receptacle along said paths.

6. The apparatus of claim 5, wherein said moving member has a mouse appearance.

7. The apparatus of claim 5, wherein said plurality of obstacles comprise a triangular shape, a rectangular shape and a circular shape.

8. The apparatus of claim 1, wherein said raised and lowered structures define a plurality of receptacles.

9. The apparatus of claim 8, wherein said plurality of receptacles have pockets of differing shapes and depths to capture said moving member.

10. The apparatus of claim 9, further comprising a plurality of moving members equal to said plurality of receptacles.

11. The apparatus of claim 10, wherein said raised and lowered structures are disposed radially inward from said plurality of receptacles.

12. The apparatus of claim 11, wherein there are three moving members and three receptacles.

13. The apparatus of claim 12, wherein one receptacle is U-shaped, one receptacle is Y-shaped and one receptacle is V-shaped.

14. The apparatus of claim 1, further comprising strap means mounted to said housing to provide balance support for a user.

15. The apparatus of claim 14, wherein said strap means comprise a bracket for latching connection to said housing, a belt attached to said bracket, a buckle mechanism for adjusting a length of said belt, and a handle attached to said belt for grasping by the user.

16. The apparatus of claim 15, wherein said strap means comprise a first strap mounted to said housing proximate an outer periphery of said first support surface and a second strap mounted to said housing proximate an outer periphery of said second support surface.

17. The apparatus of claim 1, wherein said housing comprises plastic, molded walls.

18. The apparatus of claim 17, wherein said walls define grasping recesses disposed below each of said first and sad second support surfaces.

* * * * *